US006056851A

United States Patent [19]

Hsieh et al.

[11] Patent Number: 6,056,851

[45] Date of Patent: May 2, 2000

[54] SLURRY SUPPLY SYSTEM FOR CHEMICAL MECHANICAL POLISHING

[75] Inventors: Shih-Huang Hsieh, Niao-Sung; Li-Dum Chen, Hsin-Chu, both of Taiwan

[73] Assignee: Taiwan Semiconductor Manufacturing Company, Hsin-Chu, Taiwan

[21] Appl. No.: 09/134,549

[22] Filed: Aug. 14, 1998

Related U.S. Application Data

[62] Division of application No. 08/668,796, Jun. 24, 1996.

[51] Int. Cl.[7] ..... B24B 21/04

[52] U.S. Cl. ..... 156/345; 451/527

[58] Field of Search ..... 156/345; 451/527

[56] References Cited

U.S. PATENT DOCUMENTS

| | | | |
|---|---|---|---|
| 3,615,955 | 10/1971 | Regh | 156/345 |
| 5,246,525 | 9/1993 | Sato | 156/345 |
| 5,492,594 | 2/1996 | Burke et al. | 216/86 |
| 5,650,039 | 7/1997 | Talieh | 216/89 |
| 5,899,799 | 5/1999 | Tjaden et al. | 451/287 |

*Primary Examiner*—Randy Gulakowski
*Assistant Examiner*—Shamim Ahmed
*Attorney, Agent, or Firm*—George O. Saile; Stephen B. Ackerman

[57] ABSTRACT

A chemical mechanical polishing apparatus for semiconductor wafers that ensures uniform planarization of said wafers is described. Said chemical mechanical polishing apparatus comprises a slurry supply system that channels slurry through the platen and pad, and a carrier head with provision to hold the wafer. The pad contains grooves for uniform distribution of the slurry under the rotating wafer thus eliminating uneven planarization as in prior art.

11 Claims, 2 Drawing Sheets

SLURRY SUPPLY SYSTEM FOR CHEMICAL MECHANICAL POLISHING

This is a division of patent application Ser. No. 08/668,796, filing date Jun. 24, 1996, A Novel Slurry Supply System For Chemical Mechanical Polishing, assigned to the same assignee as the present invention.

BACKGROUND OF THE INVENTION

1. Field of the Invention

This invention relates to chemical mechanical planarization or polishing tools. More particularly, the invention relates to the supply of slurry.

2. Description of the Prior Art

Chemical mechanical polishing (CMP) for planarization of semiconductor wafers is widely used in the manufacture of integrated circuits (IC's). CMP differs from straight mechanical polishing by virtue of the fact that a chemical etchant is supplied at the same time. Said etchant does not fully dissolve the surface but instead produces a layer of low mechanical integrity that is easily removed with fine abrasive. This eliminates the need for using a series of decreasing slurry size particles as is commonly done in mechanical polishing.

For example U.S. Pat. No. 3,615,955 (Regh et al.) discloses the use of a container with a restricted opening held over the center of the rotating platen. The distribution of the slurry across the pad is left to centrifugal forces. U.S. Pat. No. 5,492,594 (Burke et al.) shows a slurry dispenser and a dispensing arm supplying slurry somewhere between the center and rim of the pad/platen. Again the distribution of the slurry across the pad is left to centrifugal forces. U.S. Pat. No. 5,246,525 (Sato) describes a system where slurry is distributed through the platen and exits through a plurality of supply ports concentrically located on the pad in various arrangements and with independent slurry supply means. Use of three independent slurry supply means make the method more expensive and therefore the cost of wafer production is greater.

SUMMARY OF THE INVENTION

It is an object of the present invention to include a chemical mechanical polishing method wherein slurry distribution is uniform.

It is another object of this invention wherein a uniform polish rate is achieved.

It is yet another object of this invention wherein a uniform planarization of the wafer is achieved.

These objectives have been accomplished by dispensing slurry from grooves cut into the pad, by admitting the slurry from the bottom of the platen and delivering the slurry to said groove via internal passageways. This eliminates uneven and insufficient distribution of slurry that would otherwise be present as is the case in the prior art.

BRIEF DESCRIPTION OF THE DRAWINGS

These drawings are not intended to imply limitation of the invention to a specific embodiment, but are for explanation and understanding only.

DESCRIPTION OF THE PREFERRED EMBODIMENT

Figure 1:
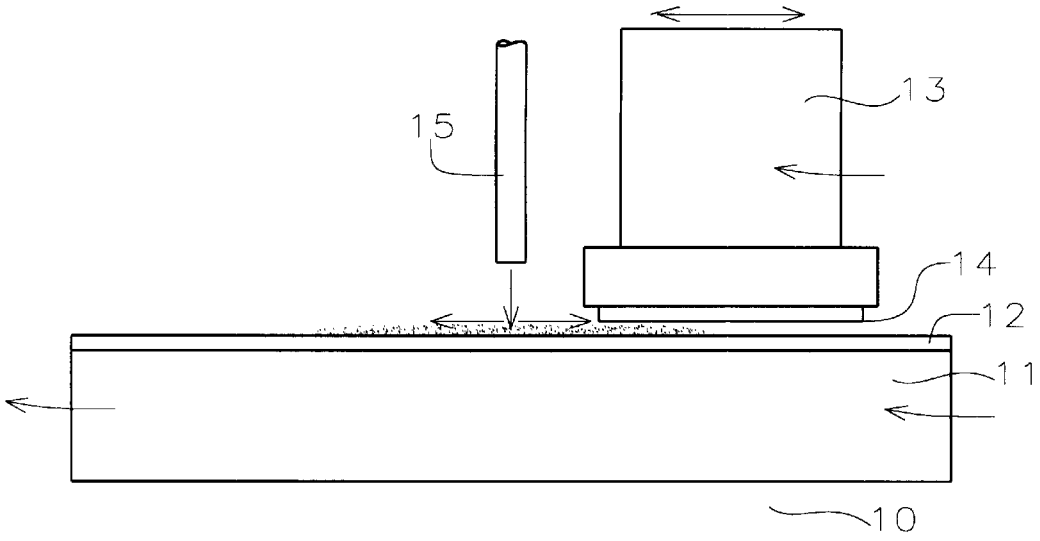
FIG. 1 Prior Art
FIG. 1 is a cross section of an example of a polishing apparatus of the prior art.
Figure 2:
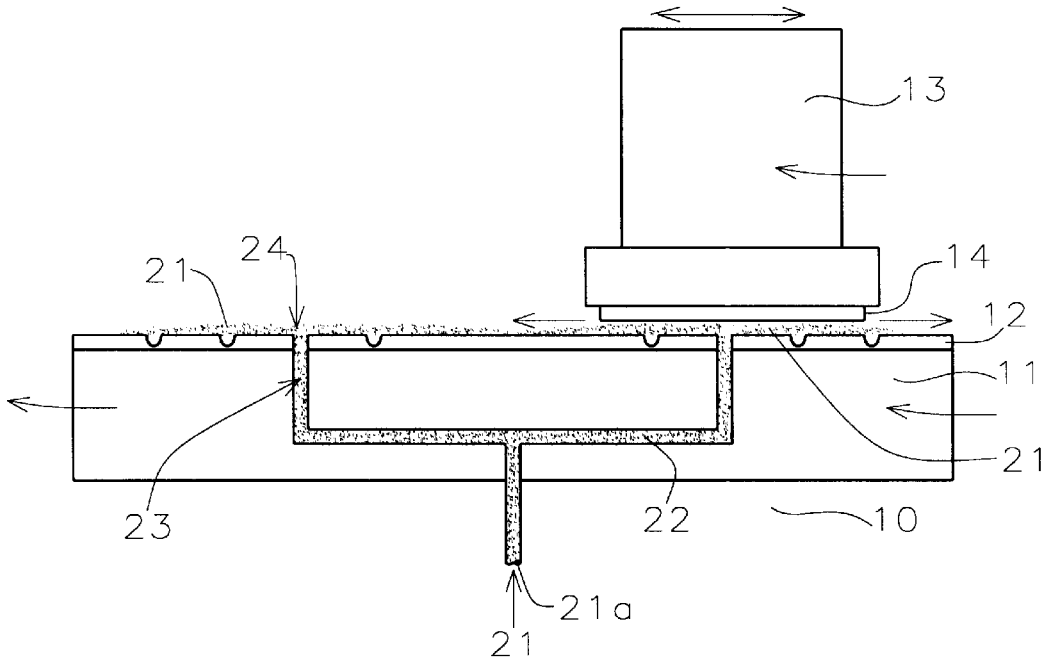
FIG. 2 is a cross section of FIG. 3 of the polishing apparatus embodying the present invention.
Figure 3:
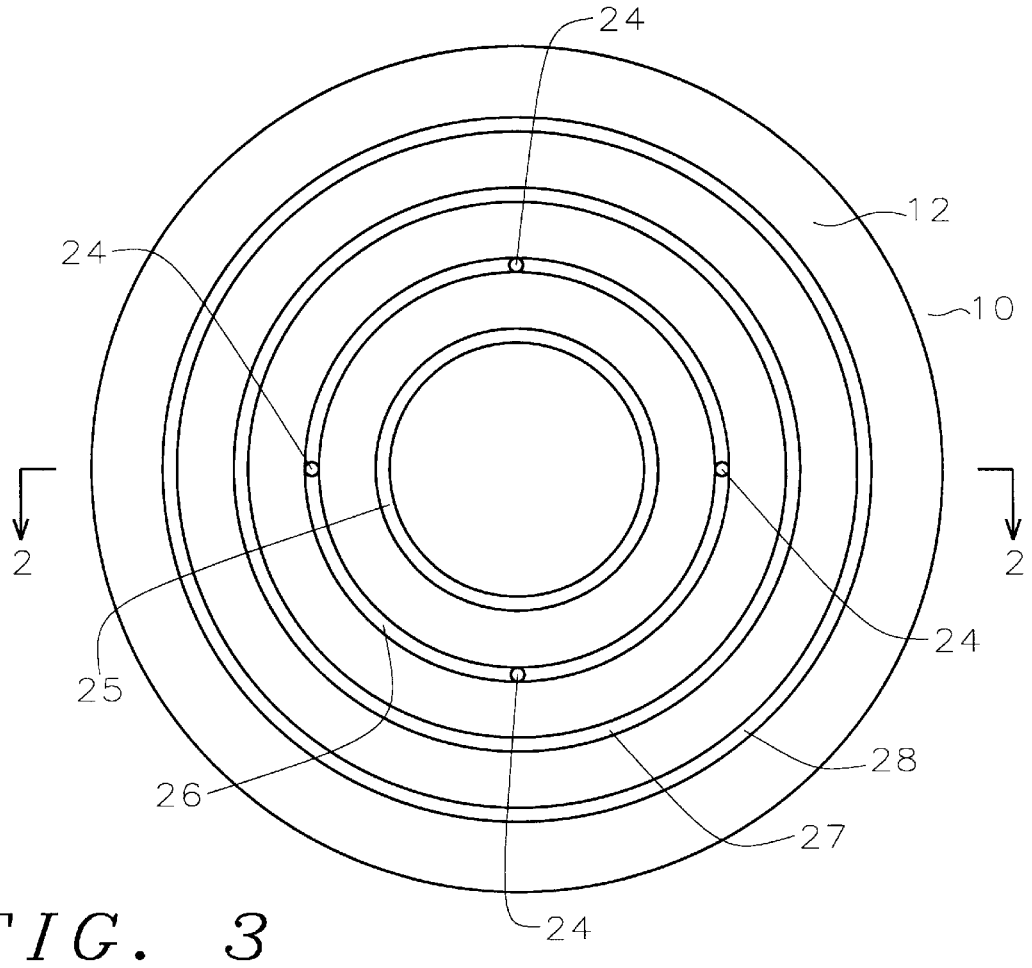
FIG. 3 is a top view of the platen of the present invention showing the arrangement of the grooves and exit ports.

Referring now to FIG. 2, a wafer polishing or planarization apparatus 10 embodying the present invention is shown. This apparatus includes a platen 11 able to rotate about a center of rotation. A pad 12 is placed on top of platen 11. A rotating and oscillating carrier head 13 with motor (not shown) rotates wafer 14 and holds it face down by suitable means. Slurry 21 enters platen 11 at an underside entrance passage 21*a*, moves through embedded passageways 22, and exits the top of the platen at ports 23. The number of ports 23 may vary. We have found the number four to be good, but any number from about 2 to about 16 may be used. Rotation of platen 11 and pad 12 is induced by the rotation of wafer 14. Typically the platen rotates at about 30 revolutions per minute, but this number could range anywhere from about 1 to 100 r.p.m. Port 23 aligns with wafer 14 as shown in FIG. 2. FIG. 3 shows slurry exit ports 24 in pad 12 lining up with ports 23 in platen 11. Four grooves 25 26 27 28 are cut into pad 12. It will be understood that more grooves could be used inside or outside of groove 26. The total number of grooves could range from 2 to up to 20. The form of grooves 25 26 27 28 may be elliptical or circular or any combination thereof. But they cannot be intersecting with each other. Slurry exit ports 24 are located in such a way that they fall into groove 26 and are also evenly distributed along groove 26. One groove 25 is shown closer to the center of rotation than groove 26 from which slurry exit ports 24 emerge. Two more grooves 27 and 28 are shown outside of groove 26. In addition, elliptical grooves may be combined with radial grooves (not shown) going from groove 25 to groove 28. These grooves may be radial or non-radial, but one radial groove may not intersect with another radial groove. The cross section of grooves 25 through 28 may be semicircular or V shaped. Uniform distribution of slurry 21 under wafer 14 is achieved because excess slurry can move in the grooves away from wafer 14 to the outside, thus insuring uniform planarization of wafer 14. The amount of slurry desired under wafer 14 can be further controlled by the form and cross-section of grooves 25 26 27 28.

While the invention has been particularly shown and described with reference to the preferred embodiments thereof, it will be understood by those skilled in the art that various changes in form and details may be made without departing from the spirit and scope of the invention.

What is claimed is:

1. An apparatus for chemical mechanical polishing comprising:

a platen able to rotate about a center of rotation, having embedded passageways, an underside and a top;

an entrance passage on said underside connected to said embedded passageways;

ports on said top connected to said embedded passageways;

on said platen, a pad, having grooves with slurry exit ports;

a rotating and oscillating carrier head for wafers; and a slurry supply means.

2. The pad of claim 1, where the number of grooves ranges from about 2 to about 20.

3. The pad of claim 1, where the form of the grooves is elliptical, including circular, and non-intersecting.

4. The pad of claim 3, where there is at least one groove closer to the center of rotation than the groove at which said slurry exit ports emerge.

5. The pad of claim 1, where the form of the grooves is radial and non-intersecting.

6. The pad of claim 1, where the form of the grooves is non-radial, and non-intersecting.

7. The pad of claim 1, where the form of the grooves is a combination of elliptical and radial.

8. The pad of claim 1, where said grooves have a cross section that is semicircular.

9. The pad of claim 1, where said grooves have a cross section that is V shaped.

10. The pad of claim 1, where the number of slurry exit ports ranges from about 2 to about 16.

11. The pad of claim 1, where the slurry exit ports are evenly distributed.

* * * * *